US006669517B1

(12) United States Patent
Alby et al.

(10) Patent No.: US 6,669,517 B1
(45) Date of Patent: Dec. 30, 2003

(54) MULTIPLE PART COWL STRUCTURE FOR AN OUTBOARD MOTOR

(75) Inventors: Jeremy L. Alby, Oshkosh, WI (US); Martin E. Olson Gunderson, Oshkosh, WI (US); Stuart M. Halley, Brownsville, WI (US); Timothy D. Krupp, Fond du Lac, WI (US); Darin C. Uppgard, Neshkoro, WI (US); Thomas J. Walczak, Oconomowoc, WI (US); John F. Zebley, Jr., Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/172,344

(22) Filed: Jun. 14, 2002

(51) Int. Cl.[7] ..... B63H 20/32
(52) U.S. Cl. ..... 440/77; 123/195 P
(58) Field of Search ..... 440/76, 77, 52; 123/195 C

(56) References Cited

U.S. PATENT DOCUMENTS

| | | | | |
|---|---|---|---|---|
| 3,955,526 A | | 5/1976 | Kusche | 115/17 |
| 4,348,194 A | | 9/1982 | Walsh | 440/77 |
| 4,600,396 A | | 7/1986 | Crane et al. | 440/77 |
| 4,875,883 A | | 10/1989 | Slattery | 440/77 |
| 4,878,468 A | | 11/1989 | Boda et al. | 123/195 |
| 4,927,194 A | | 5/1990 | Wagner | 292/128 |
| 5,069,643 A | | 12/1991 | Westberg et al. | 440/77 |
| 5,083,949 A | * | 1/1992 | Breckenfeld et al. | 440/52 |
| 5,096,208 A | | 3/1992 | Westberg | 277/181 |
| 5,120,248 A | | 6/1992 | Daleiden et al. | 440/77 |
| 5,302,147 A | * | 4/1994 | Oishi | 440/77 |
| 5,338,236 A | | 8/1994 | Dunham et al. | 440/77 |
| 5,803,777 A | | 9/1998 | Hiraoka | 440/77 |
| 5,921,827 A | | 7/1999 | Ichihashi | 440/77 |
| 6,024,616 A | | 2/2000 | Takayanagi | 440/77 |
| 6,176,751 B1 | | 1/2001 | Takahashi | 440/77 |

* cited by examiner

*Primary Examiner*—Jesus D. Sotelo
(74) *Attorney, Agent, or Firm*—William D. Lanyi

(57) ABSTRACT

A cowl structure comprises first and second cowl members that are independent components. A first cowl member is attachable, by a latch mechanism, to a support structure of the outboard motor. The second cowl member is attachable by a latch mechanism, to both the first cowl member and the support structure. The first cowl member extends across a rear portion of the outboard motor and at least partially along both port and starboard sides of the outboard motor. The second cowl member extends across a front portion of the outboard motor and at least partially along the port and starboard sides of the outboard motor. In a preferred embodiment, the second cowl member also extends partially over a top portion of the outboard motor and over a rear portion of the outboard motor.

12 Claims, 9 Drawing Sheets

MULTIPLE PART COWL STRUCTURE FOR AN OUTBOARD MOTOR

BACKGROUND OF THE INVENTION

1. Field of the Invention

The present invention generally relates to a cowl structure for an outboard motor and, more particularly, to a cowl structure that incorporates multiple pieces that are shaped to be attached together to form a cowl of an outboard motor.

2. Description of the Prior Art

Various types of cowls are well known to those skilled in the art. Also, various latching mechanisms, for use in conjunction with cowls, are well known to those skilled in the art.

U.S. Pat. No. 4,878,468, which issued to Boda et al on Nov. 7, 1989, discloses a cowl assembly for an outboard motor. The cowl ass upper cowl section and a lower cowl section and includes various features for improving the structural integrity of the cowl assembly and for providing a water resistance seal at the joint between the cowl sections and at various points of entry of cables and other mechanical devices. A cut-out portion in the side of the lower cowl assembly is adapted to receive various cables and shift levers for different configurations of outboard marine motors (e.g. a manual tiller operated motor including shift controls, a manual tiller operated motor having a separate shift lever and a remote control motor having throttle and shift cables leading into the engine cavity). A sealing mechanism is provided at the cut-out portion of the lower assembly, to provide a water resistant seal at the points of entry of the cables or shift lever through the lower cowl section.

U.S. Pat. No. 4,875,883, which issued to Slattery on Oct. 24, 1989, discloses a latch assembly for releasably securing cowl sections of an outboard motor. The cowl assembly for an outboard motor includes an upper cowl section and a lower cowl section and is provided with an improved latch assembly. The latch assembly incorporates a pivotal hook connected to one of the cowl sections which is engageable with a hook engaging member provided on a catch mechanism connected to the other cowl section. Due to the presence of the compressible seal between the upper and lower cowl sections, relative vertical movement is possible therebetween and thereby between the hook and the hook engaging member. The improved latch mechanism incorporates a retainer mechanism for preventing disengagement of the hook from the catch mechanism during such relative vertical movement of the cowl sections for ensuring that the cowl sections remain secure together during compression of the compressible seal between the cowl sections.

U.S. Pat. No. 3,955,526, which issued to Kusche on May 11, 1976, discloses a cowl apparatus for outboard motors. An outboard motor cowl includes separate starboard and port cowl members which are each individually, removably hinged to the rear of the engine by a pair of space hinge units which allow separate attachment and removal of the cowl halves. The forward ends of the cowl members are releasably connected to separate and independent mounts. The uppermost aft hinge unit is visible from the front of the motor. Each hinge unit includes a receptacle secured to a mounting plate and a hinge pin secured to the inside of the cowl member in slightly spaced relation to the aft edge. The receptacle is spaced from a back edge sealing bracket and includes a guide member to receive and guide the cowl member. The top hinge pin is longer than the lowermost pin and serves to pilot the lower pin into the proper position. The hinge receptacle and pin support include interfering members which hold the cowl downward in the normal closed position and requires slight pivotal movement of the cowl to release the hold down members. The front of the cowl members is suspended by a cowl pin which engages an oval shaped ring as the cowl member is pivoted to the closed position. The lower ring is secured to a front bracket plate having resilient clamping pads on the ends which cooperate with similar resilience clamping pads in the adjacent cowl to support the throttle cable to one side and the gas line to the opposite side.

U.S. Pat. No. 6,176,751, which issued to Takahashi on Jan. 23, 2001, describes an engine cover unit of an outboard motor. The engine is cover by an engine cover unit and the engine cover unit comprises a lower cover section covering a surrounding of a lower portion of an engine in a usable state of an outboard motor arranged vertically, an upper cover section covering a surrounding of an upper portion of the engine, the upper cover section being mounted to be detachable to the lower cover section so as to provide an engine cover when mounted, and a height adjusting device provided for an inside surface of the lower cover section and adapted to adjust a height of the engine cover. The height adjusting device comprises a holder mounting section integrally mounted to the inside portion of the lower cover section and formed with a holder insertion groove, a cushion holder to be inserted into the holder insertion groove, an elastic member mounted to the cushion holder to be movable in an axial direction thereof, and a rib member provided to the upper cover section, the rib member having an end portion abutting against the elastic member in a state that the upper cover section is closed.

U.S. Pat. No. 6,024,616, which issued to Takayanagi on Feb. 15, 2000, describes an engine cover of an outboard motor. The outboard motor includes an engine which is covered by an engine cover which is formed with a cylindrical air suction port having an opening opened to an upper surface of the engine cover in a state of the outboard motor mounted to a hull and a portion of an opening area of the opening is covered by a lid member which is formed to a rear edge portion of the opening.

U.S. Pat. No. 5,921,827, which issued to Ichihashi on Jul. 13, 1999, describes an outboard motor. The outboard motor includes an engine bottom cover member which is disposed in a space between a front portion of an under cover and an upper portion of an outboard motor attachment mechanism and conceals a bottom end portion of an engine from view at least in a lateral direction of the outboard motor. The outboard motor has a concealed engine bottom portion which is sightly in appearance. The engine bottom cover member is formed integrally with an under cover and, hence, it can be assembled automatically when the under cover is attached to the under case.

U.S. Pat. No. 5,803,777, which issued to Hiraoka on Sep. 8, 1998, describes a latch for an outboard motor protective cowling. A latching assembly for engaging and disengaging an upper cover portion and lower tray portion of a cowling of an outboard motor is described. The lower tray portion includes a recess in which part of the latching assembly is located. The latching assembly includes a shaft mounted to the lower tray portion. A latch is rotatably secured to the shaft and movable between an engaged and disengaged position. The latch is disposed within the recess when engaged so that it is flush with the exterior of the cowling. A catch is mounted to the upper cover portion and is engageable by the latch hook. A mechanism for biasing the latch to the engaged or disengaged position is provided for preventing the latch from moving from the engaged or disengaged position.

U.S. Pat. No. 5,096,208, which issued to Westberg on Mar. 17, 1992, describes a motor cover seal. The seal is intended for use in sealing opposed edges of upper and lower outboard motor covers and includes an elongate body constructed and arranged for disposition between the opposed edges of the upper and lower covers. An attachment portion on the body is configured to be secured to the lower motor cover and a compressible portion on the body is configured to be compressed by the closing of the upper motor cover against the lower motor cover.

U.S. Pat. No. 5,069,643, which issued to Westberg et al on Dec. 3, 1991, describes a molded lower motor cover. A molded lower motor cover for an outboard motor includes a first cover portion and a second cover portion. The second cover portion is generally a mirror image of the first cover portion. A laterally opening groove formation is disposed generally horizontally relative to an interface of an outer wall of each of the cover portions and each groove formation is integrally joined to the wall by a web configured so that its attachment to the interface will not be visible on the external surface of the outer wall. When the first and second cover portions are fastened to each other, the groove formations sealingly accommodate an upper portion of the motor exhaust housing.

U.S. patent application Ser. No. 09/880,380 (M09531) which was filed on Jun. 13, 2001, discloses a structural support system for an outboard motor. The support system is provided for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of an outboard motor. Although precise perpendicularity with the driveshaft axis is not required, it has been determined that if the plane extending through the connectors is within forty-five degrees of perpendicularity with the driveshaft axis, improved vibration isolation can be achieved. A support structure, or support saddle, completely surrounds the engine system in the plane of the connectors. All of the support of the outboard motor is provided by the connectors within the plane, with no additional support provided at a lower position on the outboard motor driveshaft housing.

U.S. Pat. No. 5,338,236, which issued to Dunham et al on Aug. 16, 1994, describes a latch mechanism for an outboard motor cowl assembly. The outboard motor comprises a propulsion unit including a propeller shaft and a power head drivingly connected to the propeller shaft, and a cowling surrounding the power head, the cowling comprising a first cover member including an outer surface having therein a recess, a second cover member mating with the first member, and a selectively engageable latch mechanism for securing the second member to the first member, the latch mechanism including a latch handle which is supported by the first member, which is movable in a first direction between a flush position wherein the latch handle is in the recess and is flush with the remainder of the outer surface and a non-flush position wherein the latch handle extends from the recess and which is movable in a second direction to engage and disengage the latch mechanism.

U.S. Pat. No. 5,120,248, which issued to Daleiden et al on Jun. 9, 1992, discloses a cam-type latching mechanism for securing cowl sections together. The latch mechanism for securing upper and lower cowl sections of an outboard motor is described. The latch system comprises a catch assembly located at one end of the cowl assembly and a latch mechanism located at the other end of the assembly. The catch assembly includes a catch block mounted to one of the cowl sections with a catch slot formed in the catch block. A roller member is mounted to the other of the cowl sections for engaging the catch slot. The catch slot is formed so as to provide an end wall against which the roller is maintained when the cowl sections are secured together with the material of the catch block engaging the roller member to prevent relative vertical movement between the cowl sections. A cam block is located at the same end of the cowl assembly as the latch mechanism and is mounted to one of the cowl sections. A cam follower is mounted to the other of the cowl sections and engages a cam surface formed on the cam block for facilitating movement of the roller member into the catch slot. A stationary latch member is engageable by a movable latch member in response to movement of a latch handle to maintain the cam follower within the cam slot and thereby to maintain the catch rollers within the catch slots. Relative vertical and horizontal movement between the cowl sections is thus prevented.

U.S. Pat. No. 4,927,194, which issued to Wagner on May 22, 1990, describes a interlock latch assembly for releasably securing cowl sections of an outboard motor. An interlock mechanism is provided for a latch assembly which releasably secures upper and lower cowl sections of an outboard motor. The interlock mechanism is movable between a locking position and released position and is normally disposed in its locking position, such as by a coil spring. The interlock mechanism is mounted to the latch handle which is pivotably mounted to one of the cowl sections. A hook is interconnected with the latch handle and is engageable with a catch assembly provided on the other of the cowl sections. The interlock assembly normally engages a stationary engagement pin provided on one of the cowl sections, which prevents accidental pivoting movement of the latch handle. The interlock mechanism is manually movable to its released position so that the latch handle can be pivoted so as to disengage the hook from the catch mechanism.

U.S. Pat. No. 4,600,396, which issued to Crane et al on Jul. 15, 1986, discloses a cowl latch for outboard motors. A latch for a cowl of an outboard motor engine includes a catch mounted on one of the cowl members. A lever is pivotally attached to the other cowl member and resilient spring member is pivotally attached to the lever. The lever and spring member act to provide an overcenter action on the lever when the latch is closed. The lever includes a shield to conceal the latch assembly.

U.S. Pat. No. 4,348,194, which issued to Walsh on Sep. 7, 1982, describes a cowl for an outboard motor. A cowl for the power head of an outboard motor includes two bottom cowl members attached together by screws which also mount a latch bracket and a hinge member. The latch bracket supports a latch mechanism which, with the hinge member serves to hold a top cowl member in place.

The patents described above are hereby expressly incorporated by reference in the description of the present invention.

As described above, many different types of engine covers, or cowls, are well known to those skilled in the art. Some of the cowls are formed in two pieces that are assembled together to provide a covering for the engine of the outboard motor. Some of the patents described above relate to the upper cowl assembly for an outboard motor and others relate to the lower cowl. Several of the patents described above describe latching mechanisms that can be used to attach one section of a cowl to another section.

It would be beneficial if a cowl structure could be provided which allows one section of an upper cowl assembly to be removed while the other section remains in place and attached to the outboard motor support assembly. This allows maintenance and inspection to be provided with regard to the engine and associated components without necessarily requiring the entire cowl to be removed. It would also be beneficial if a latching mechanism could be provided, to attach cowl sections together, which is both easy to use and inexpensive to manufacture and assemble. It would also be beneficial if the latching mechanism for an outboard motor could reduce the number of components necessary to form the mechanism, thus reducing the overall assembly time and the number of metallic components which add to the weight of the outboard motor.

SUMMARY OF THE INVENTION

An outboard motor, made in accordance with the preferred embodiment of the present invention, comprises a first cowl member which is attachable to a support structure of an outboard motor. The first cowl member is extendible across a rear portion of the outboard motor and at least partially extendible along both port and starboard sides of the outboard motor. It also comprises a second cowl member which is attachable to the support structure and to the first cowl member. The second cowl member is extendible across a front portion of the outboard motor and at least partially extendible along the port and starboard sides of the outboard motor.

When used in conjunction with an outboard motor, the present invention further comprises the support structure and a first latch mechanism for attaching the first cowl member to the support structure. It also comprises a second latch mechanism for attaching the first cowl member to the second cowl member. The first cowl member comprises a groove which is shaped to receive a protruding edge formed on the support structure. The present invention further comprises a hinge about which the second cowl member is rotatable relative to the support structure. The first and second cowl members are supported by the support structure.

When used in conjunction with an outboard motor, the present invention further comprises an internal combustion engine disposed under the first and second cowl members and supported by the support structure through isolated resilient mounts. The second cowl extends at least partially over a top portion of the outboard motor in a preferred embodiment and also extends at least partially over a rear portion of the outboard motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
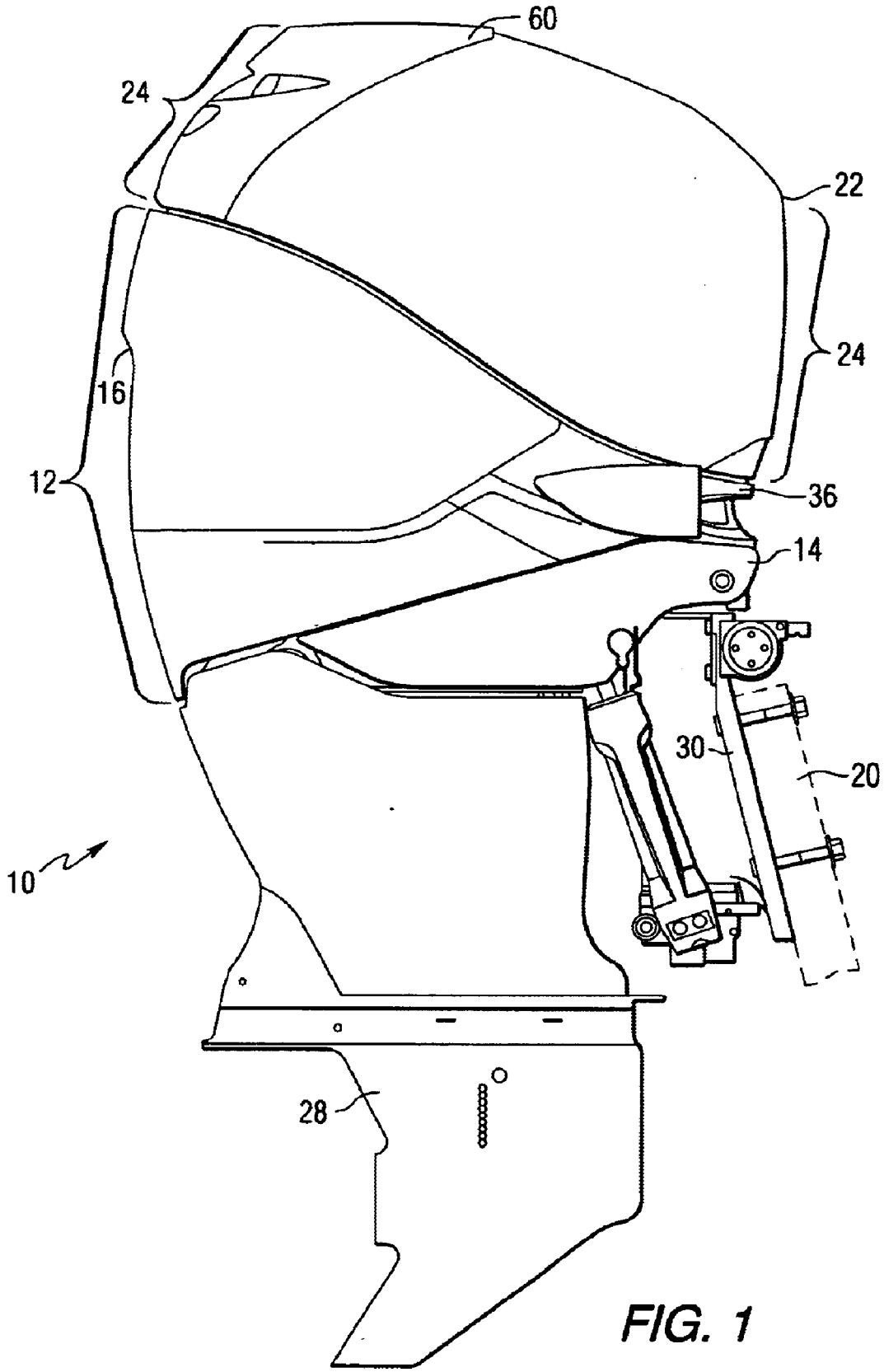
FIG. 1 is a side view of an outboard motor made in accordance with the present invention.

Throughout the description of the preferred embodiment of the present invention, like components will be identified by like reference numerals.

FIG. 1 is a side view of an outboard motor 10 made in accordance with the preferred embodiment of the present invention. It comprises a first cowl member 12 which is attachable to a support structure 14 of the outboard motor 10. It should be understood that the present invention is directly related to the cowl portions above the support structure 14. The cover members disposed around the support structure 14 are sometimes referred to as the "lower pan" or "lower cowl", but this structure does not relate directly to the present invention other than the support it provides.

The first cowl member 12 is extendible across a rear portion 16 of the outboard motor 10 and at least partially extendible along both port and starboard sides of the outboard motor 10. With respect to the transom 20, which is shown in dashed lines, the view in FIG. 1 is the starboard side of the outboard motor 10 with the rear portion 16 toward the left in FIG. 1 and the front portion 22 toward the right. A second cowl member 24 is attachable to both the support structure 14 and to the first cowl member 12 and is in contact with the component identified by reference numeral 36 which will be discussed below. The second cowl member 24 is extendible across a front portion 22 of the outboard motor 10 and at least partially extendible along the port and starboard sides of the outboard motor 10.

As discussed above, the outboard motor 10 also comprises the support structure 14, an engine, adapter plate, and driveshaft housing resiliently supported by the support structure, and a gear case 28. As will be described in greater detail below, a first latch mechanism is provided for attaching the first cowl member 12 to the support structure 14 and a second latch mechanism is provided for attaching the second cowl 24 to the first cowl 12.

With continued reference to FIG. 1, the outboard motor 10 is provided with a transom plate 30 which allows the outboard motor 10 to be rigidly attached to a transom 20 of a marine vessel. Alternative configurations are also available in which a jack plate can be provided in association with the transom plate 30 to allow positional adjustment of the outboard motor relative to the marine vessel.

Figure 2:
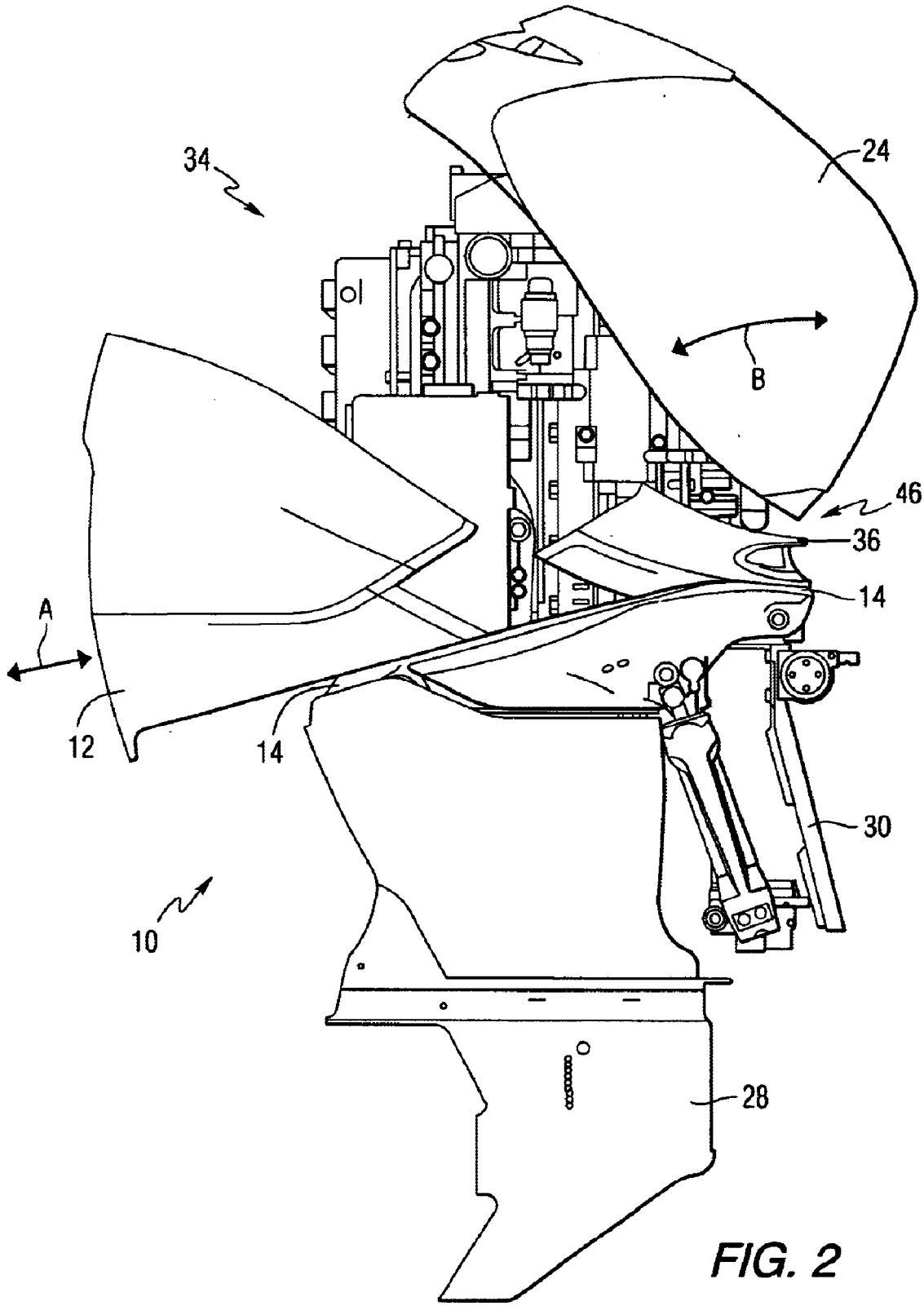
FIG. 2 is an exploded view of the cowl portion of the outboard motor shown in FIG. 1.
Figure 3:
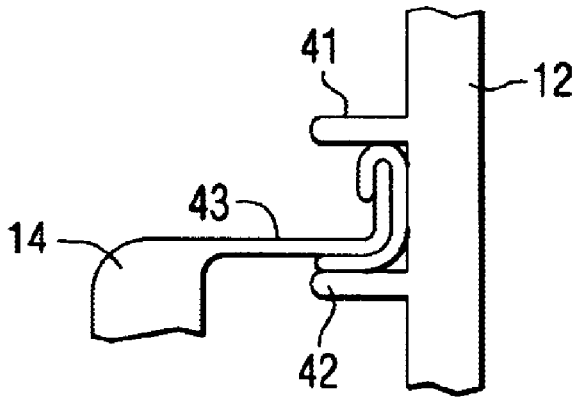
FIG. 3 is a section of a sliding track used in a preferred embodiment of the present invention

FIG. 2 shows the outboard motor 10 described above in conjunction with FIG. 1, but with the first and second cowl members, 12 and 24, illustrated in their open positions. The purpose of the cowl members is to provide a cover for the internal combustion engine 34 used as a power head for the outboard motor 10. The first cowl member 12 comprises a groove which is shaped to receive a protruding edge formed on the support structure 14. FIG. 3 is a simplified representation of the groove which is a part of the first cowl member 12 which comprises two raised portions, 41 and 42, that define a groove therebetween. The protruding edge 43 of the support structure 14 is received in the groove to guide the first cowl member 12 as it slides relative to the support structure with the protruding edge 43 disposed within the groove defined by the raised portions, 41 and 42, of the first cowl member 12. Arrow A in FIG. 2 describes the motion of the first cowl member 12 relative to the support structure 14 as it is guided by the groove and protruding edge 43. This relative motion will be described in greater detail below in conjunction with a discussion of the latching mechanism that holds the first cowl member 12 to the support structure 14.

FIG. 2 shows the second cowl member 24 rotated clockwise along the path described by Arrow B. The portion of the cover identified by reference numeral 36 in FIG. 2 is not directly related to the present invention, but provides a cover element over the region where it is located in FIGS. 1 and 2. In certain embodiments, this cover 36 can comprise two sections to facilitate assembly, by a plurality of screws, to the support structure 14.

Figure 4:
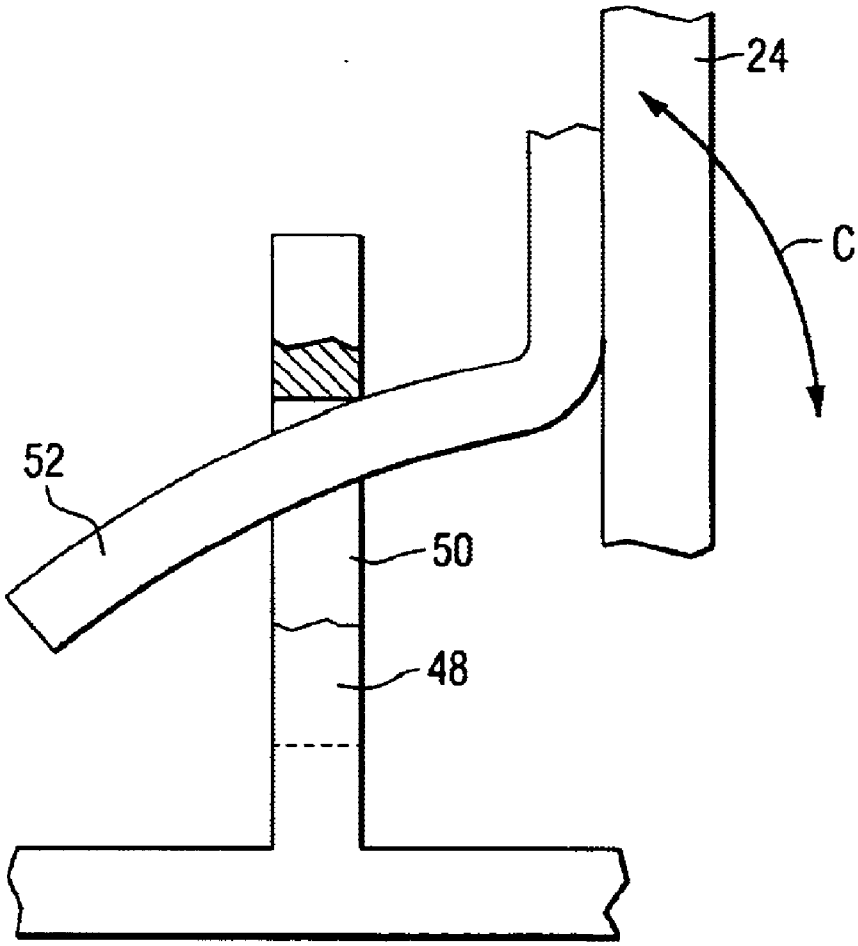
FIG. 4 is a hinge mechanism used in a preferred embodiment of the present invention

With reference to FIGS. 2 and 4, the second cowl member 24 is intended to pivot about the region identified by reference numeral 46. A bracket 48, shown in FIG. 4, is rigidly attached to the support member 14 and is provided with an opening 50 formed through it. The opening 50 is shaped to receive a tang 52 that is attached to the second cowl member 24. In order to assemble the second cowl member 24 to the support structure 14 and the first cowl member 12, the tang 52 is inserted into the opening 50 in the bracket 48 with the second cowl member 24 tilted upwardly as represented in FIG. 2. Then, with the tang 52 remaining in the opening 50, the second cowl member 24 is rotated in a counterclockwise direction downward into contact with the first cowl member 12 which has previously been moved toward the right in FIG. 2 and latched to the support structure 14. In other words, the order of assembly of the cowl members comprises the initial movement of the first cowl member 12 toward the right in FIG. 2 until it latches firmly with the support structure 14. Then, the second cowl member 24 is placed in the position shown in FIG. 2, with the tang 52 inserted into opening 50. The second cowl member 24 is then rotated in a counterclockwise direction into contact with the first cowl member 12 and the support structure 14. This places the tang 52 in its relative position within the opening 50 that is illustrated in FIG. 4. In other words, FIG. 4 shows the tang in its position that it occupies when the second cowl member 24 is fully rotated in a counterclockwise direction and attached to the first cowl member 12.

Figure 5:
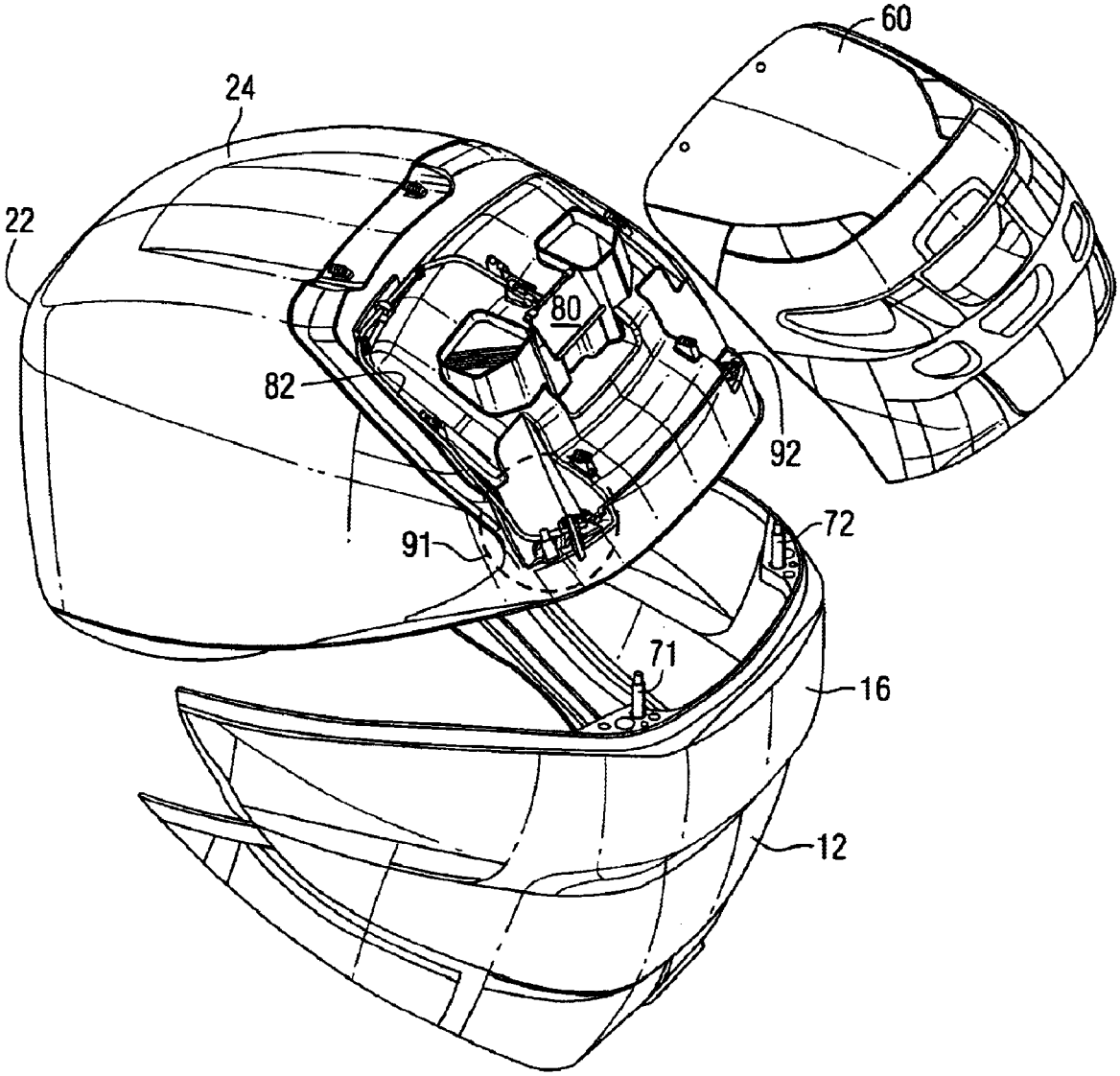
FIG. 5 is an exploded view showing the first and second cowl members and an air damcap that is associated with the second cowl member.

FIG. 5 is an exploded view of the first and second cowl members, 12 and 24, and an air dam cap 60 which is attachable to the second cowl member 24 in order to cover certain air ducts and latch mechanisms of the second cowl member 24. In FIG. 5, the air dam cap 60 is shown separated from its intended position on the second cowl member 24 in order to allow certain latch components to be illustrated.

With continued reference to FIG. 5, it can be seen that two latch pins, 71 and 72, are attached to the first cowl member 12, or first cover member, and positioned to be inserted into openings formed in the second cowl member 24,or second cover member. As will be described in greater detail below, the second cowl member 24 is provided with a handle 80 that is associated with a push-pull cable 82 in order to operate two latches, 91 and 92. Latch 91 is shown within a dashed circle in FIG. 5 and will be described in greater detail below in conjunction with FIGS. 6, 8, and 9. As can be seen in FIG. 5, the second cowl member 24 extends at least partially over a top portion of the outboard motor in addition to extending around the front, rear, and sides of the outboard motor. The first cowl member 12 extends around the rear portion 16 of the outboard motor and at least partially over its port and starboard sides.

Figure 6:
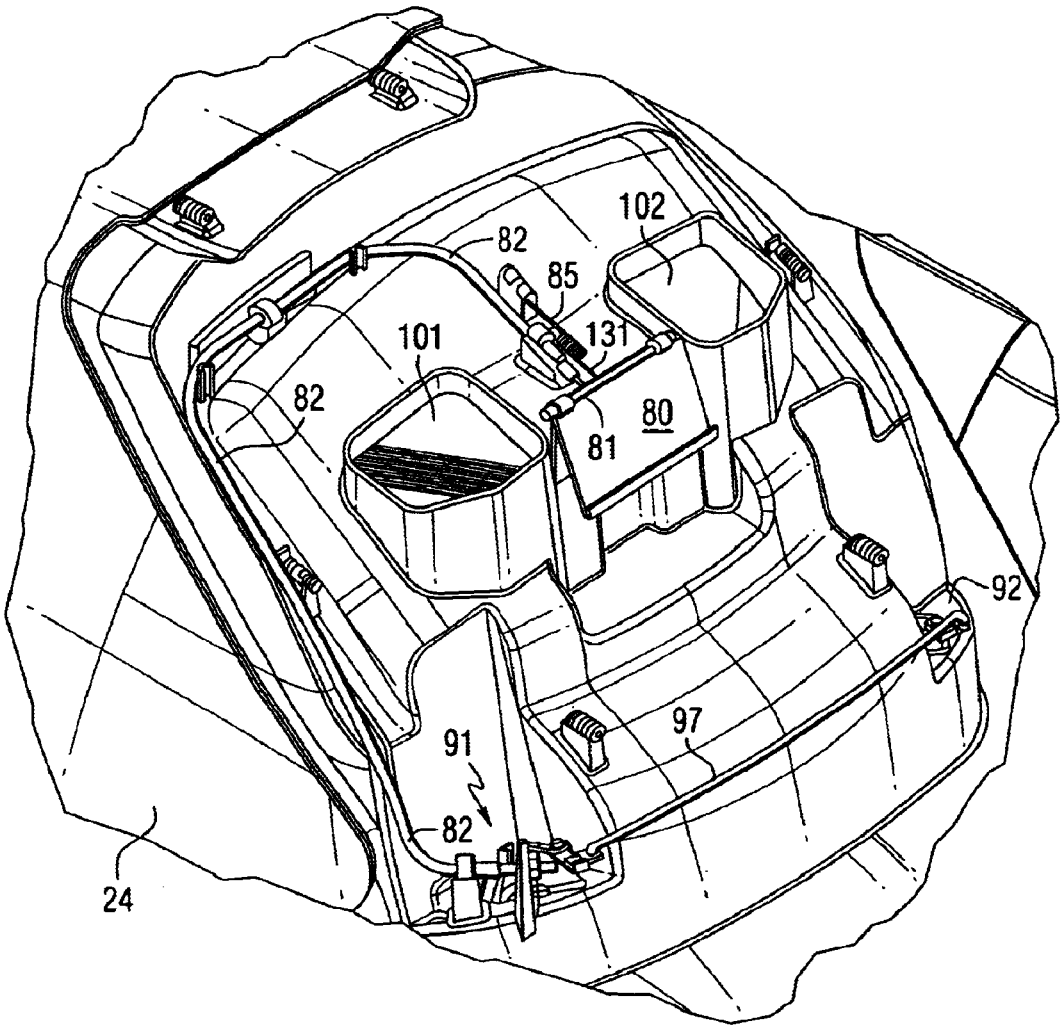
FIG. 6 is a partial view of the second cowl member, showing the latch mechanism used to attach the second cowl member to the first cowl member.

FIG. 6 is an enlarged view of a portion of the second cowl member 24. A handle 80 is pivotally attached to the second cowl member 24 for rotation about an axis 81 in response to manual movement of the handle 80. A spring 85 is provided to return the handle 80 to its deactivating position when the operation is not manually activating the handle 80. A push-pull cable 82 transfers the manually applied force on the handle 80 to the latches, 91 and 92. A connecting bar 97 transfers force between the first and second latches, 91 and 92, so that manual manipulation of the handle 80 will cause both of the latches to release the latch pins, as will be described in greater detail below. FIG. 6 illustrates the second cowl member 24 with the air dam cap 60 removed to expose the latch mechanism, handle 80 and two air intake conduits, 101 and 102.

Figure 7:
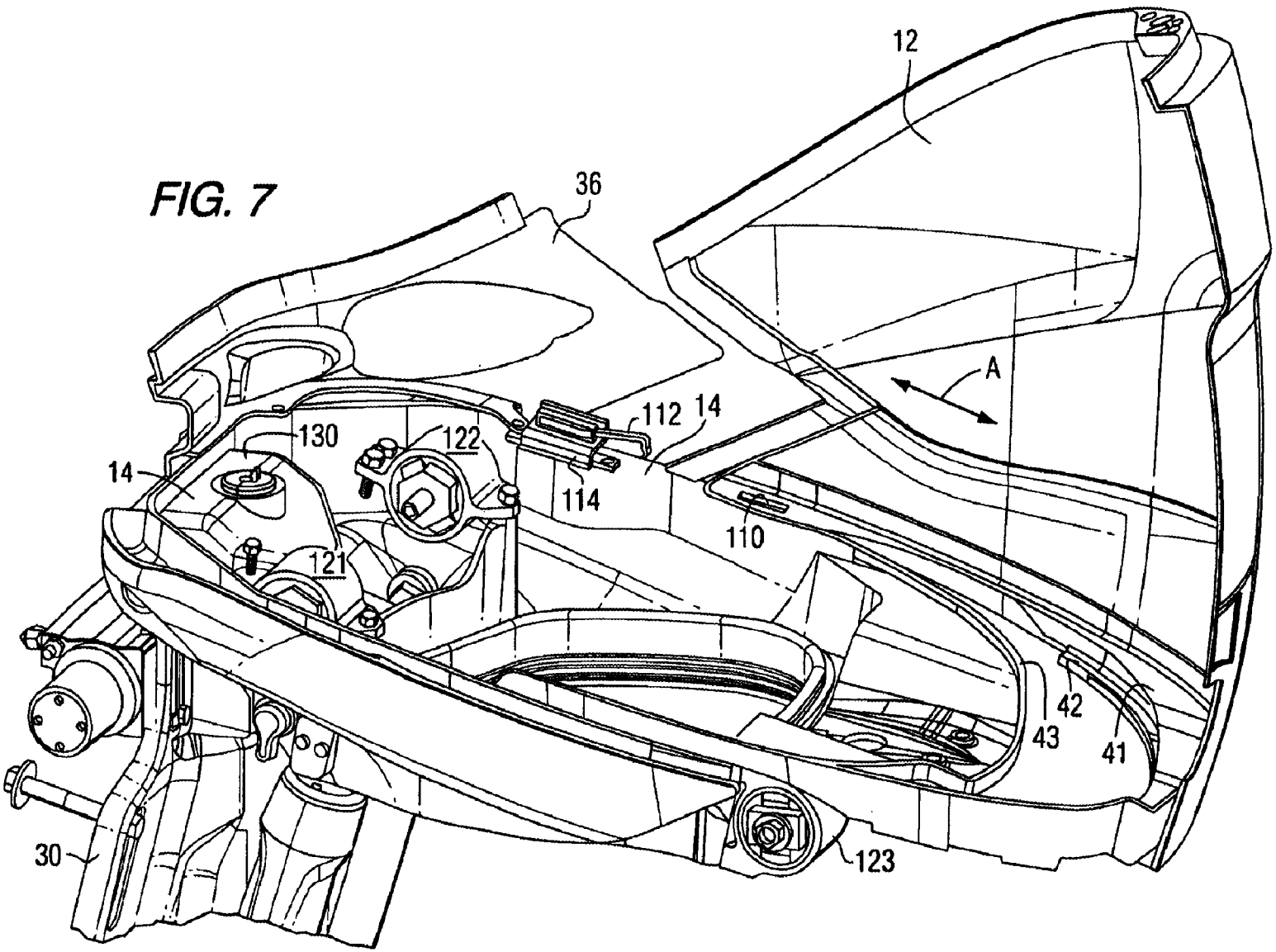
FIG. 7 is an isometric view of the first cowl member being assembled to a support structure of an outboard motor.

FIG. 7 is an isometric view of the inside portion of the support structure 14 with the first cowl member 12 moved slightly away from its latched position relative to the support structure 14. Arrow A is provided to show the relationship between FIGS. 2 and 7 and the relative positions of the first cowl member 12 and the support structure 14 in those two figures. In FIG. 7, the first cowl member 12 is moved away from its latching position relative to the support structure 14 and to the cover identified by reference numeral 36. It should also be noted that half of the cover 36 is not illustrated in FIG. 7 for purposes of clarity and the first cowl member 12 has been sectioned in order to expose certain internal components that will be described below.

As the first cowl member 12 is moved toward the left in FIG. 7, a latch opening 110 moves into position to allow a latch insert 112 to move into it. Until the latch mechanism 114 is manually deactivated, this relationship holds the first cowl member 12 firmly into position with respect to the support structure 14. As the first cowl member 12 is moved toward the left in FIG. 7, the groove between extensions 41 and 42 captures the protruding edge 43 of the support structure 14, as described above. The combination of the groove, between extensions 41 and 42, and the protruding edge 43, as discussed above in conjunction with FIG. 3, holds the first cowl member 12 in position relative to the support structure 14 in combination with the operation of two of the latches 114 described above.

With continued reference to FIG. 7, three resilient mounts, 121–123, are visible. A fourth mount is not visible in FIG. 7. This type of mounting arrangement is described in detail in U.S. patent application Ser. No. 09/880,380 which was filed on Jun. 13, 2001 (M09531) and assigned to the assignee of the present invention. The resilient mounts, 121–123, support the internal combustion engine 34 and isolate vibrations emanating from the engine. In other words, the support structure 14 is not subjected to all of the vibrations of the engine 34. As a result, the first and second cowl members, 12 and 24, are isolated from those vibrations because they are attached directly to the support structure 14 and not attached directly to the engine in a way that would allow those vibrations to be transmitted to the cowl structure. The cowl members are isolated from the drive shaft housing by the resilient mounts, 121–123. As a result, they are isolated from the exhaust noise and vibration from the propeller and propeller shaft. They are also inherently isolated from the lower pan or lower cowl and from the chaps that are attached to the drive shaft housing. Because of the large surface area of the cowl, direct contact between the cowl structure and engine would allow the transmission of the vibrations to the cowl and would likely result in excessive movement and noise during operation of the outboard motor. With reference to FIGS. 4 and 7, the bracket 48 shown in FIG. 4 is intended to be attached to the region identified by reference numeral 130 in FIG. 7.

Figure 8:
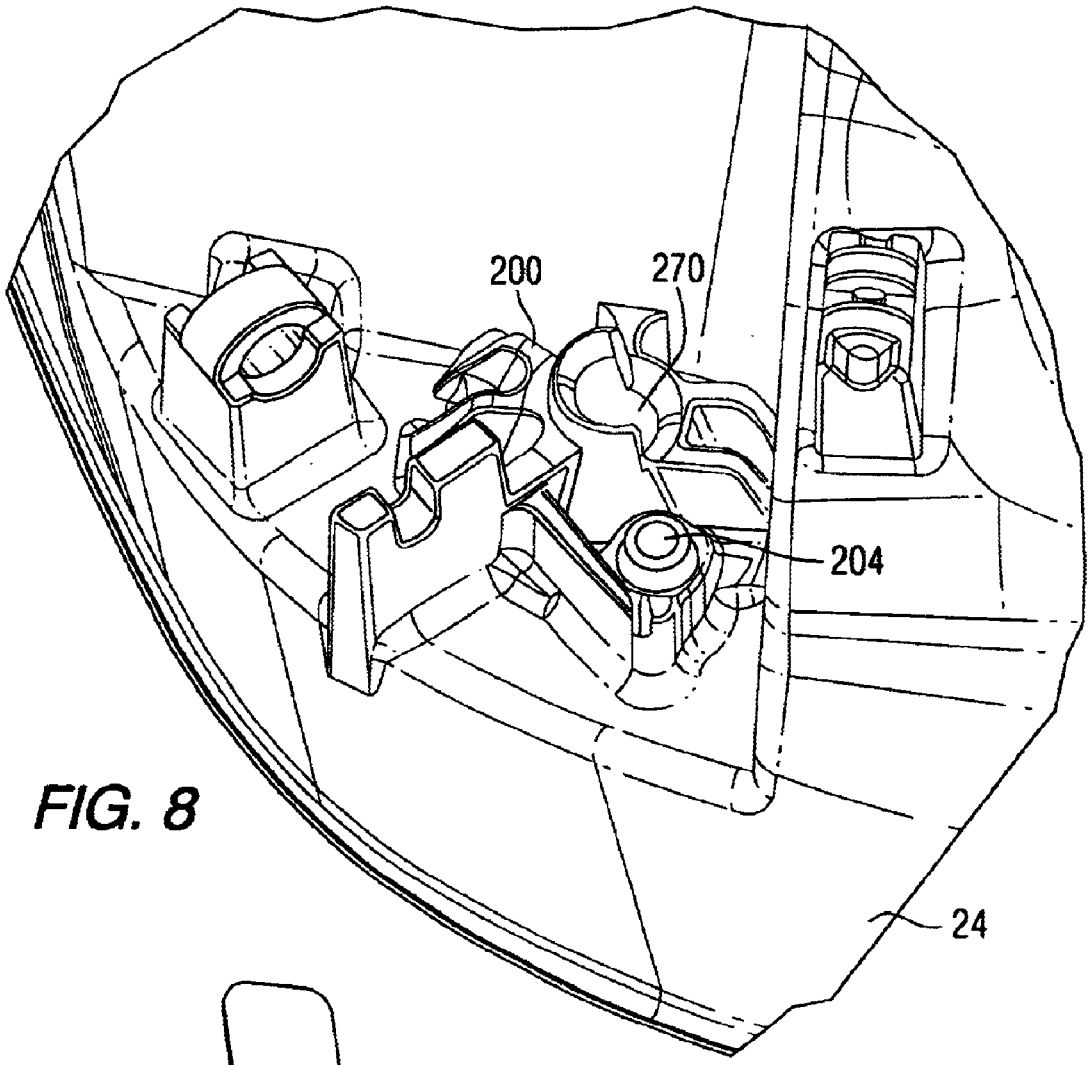
FIG. 8 shows a latch base portion formed as an integral part of a second cowl member.

FIG. 8 is a partial view of the mechanism shown in FIG. 6, particularly the portion within the dashed circle illustrated in FIG. 5. It shows a base portion 200 of the latch 91 shown in FIGS. 5 and 6. The base portion 200 of the latching device is formed as an integral part of the second cover member 24. All of the components shown in FIG. 8 are formed as integral parts of the second cover member 24, with no individual parts illustrated in the Figure.

Figure 9:
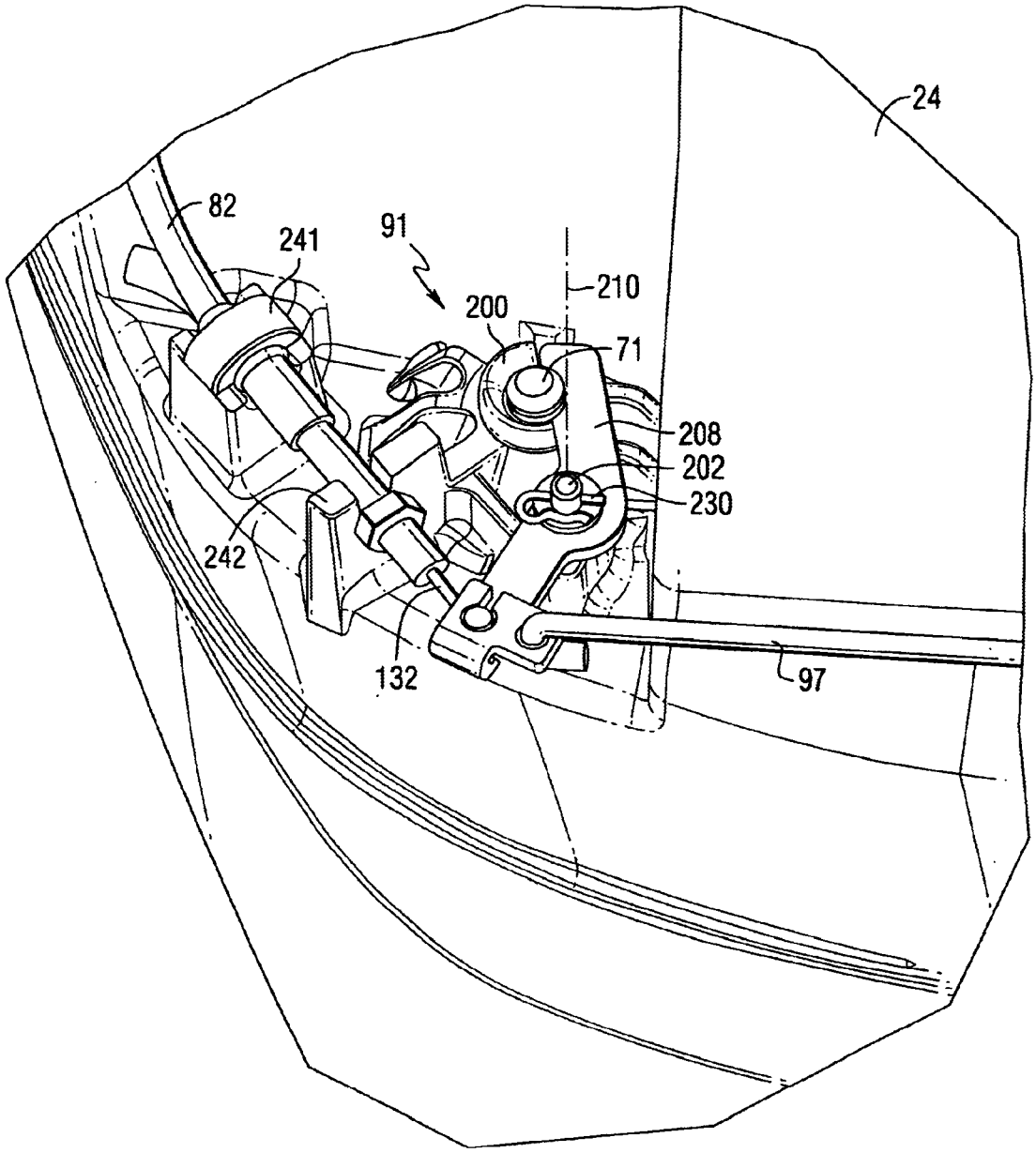
FIG. 9 shows the base portion of FIG. 8 with additional components to form the latch mechanism.

FIG. 9 illustrates the base portion 200 of the latching device 91 with certain additional components added to the second cowl member 24. With reference to FIGS. 8 and 9, a pivot member 202 extends through an opening 204 that is formed through the base portion 200. A latch 208 is attached for rotation about a central axis 210 of the pivot member 202. The latch 208 is movable between a locking position (as illustrated in FIG. 9) and an unlocking position in which the latch 208 would be rotated clockwise about axis 210 from the position shown in FIG. 9. A latch pin 71, as also illustrated in FIG. 5, is attached to the first cover member 12 and shaped to be retained by the latch 208 when the first and second cover members, 12 and 24, are in contact with each other and the latch 208 is in the locking position. A spring 85, as illustrated in FIG. 6, as well as a torsional spring which is located beneath the latch 208 and surrounding the pivot member 202 in FIG. 9, is provided for urging the latch 208 toward its locking position as shown in FIG. 9. The torsional spring located under the latch and around the pivot member 202 urges the latch 208 in a counterclockwise direction toward its latching position. A push-pull cable 82 is associated with the latch 208 to allow the handle 80 to be used to manually cause the latch 208 to rotate in a clockwise direction (with respect to FIG. 9) about axis 210 so that the latch 208 can be moved into its unlatching position to release the second cowl member 24. The pivot hole 204, illustrated in FIG. 8, is formed through the base portion 200 and shaped to receive the pivot member 202 through the pivot hole. A pin 230 is attached to the pivot member 202 to prevent the pivot member from being removed from the pivot hole 204. The push-pull cable 82 has a first end 131 attached to the handle 80, as shown in FIG. 6, and a second end 132 attached to the latch 208. As a result, movement of the handle 80 relative to the second cover member 24 will cause the latch 208 to rotate about the central axis 210 of the pivot member 202. This unlatches the second cowl member 24 from the first cowl member 12. A sheath of the push-pull cable 82 is attached to the second cover member at several locations between the handle 80 and the latch 208. Reference numerals 241 and 242 illustrate two of these attachment positions in FIG. 9.

Figure 10:
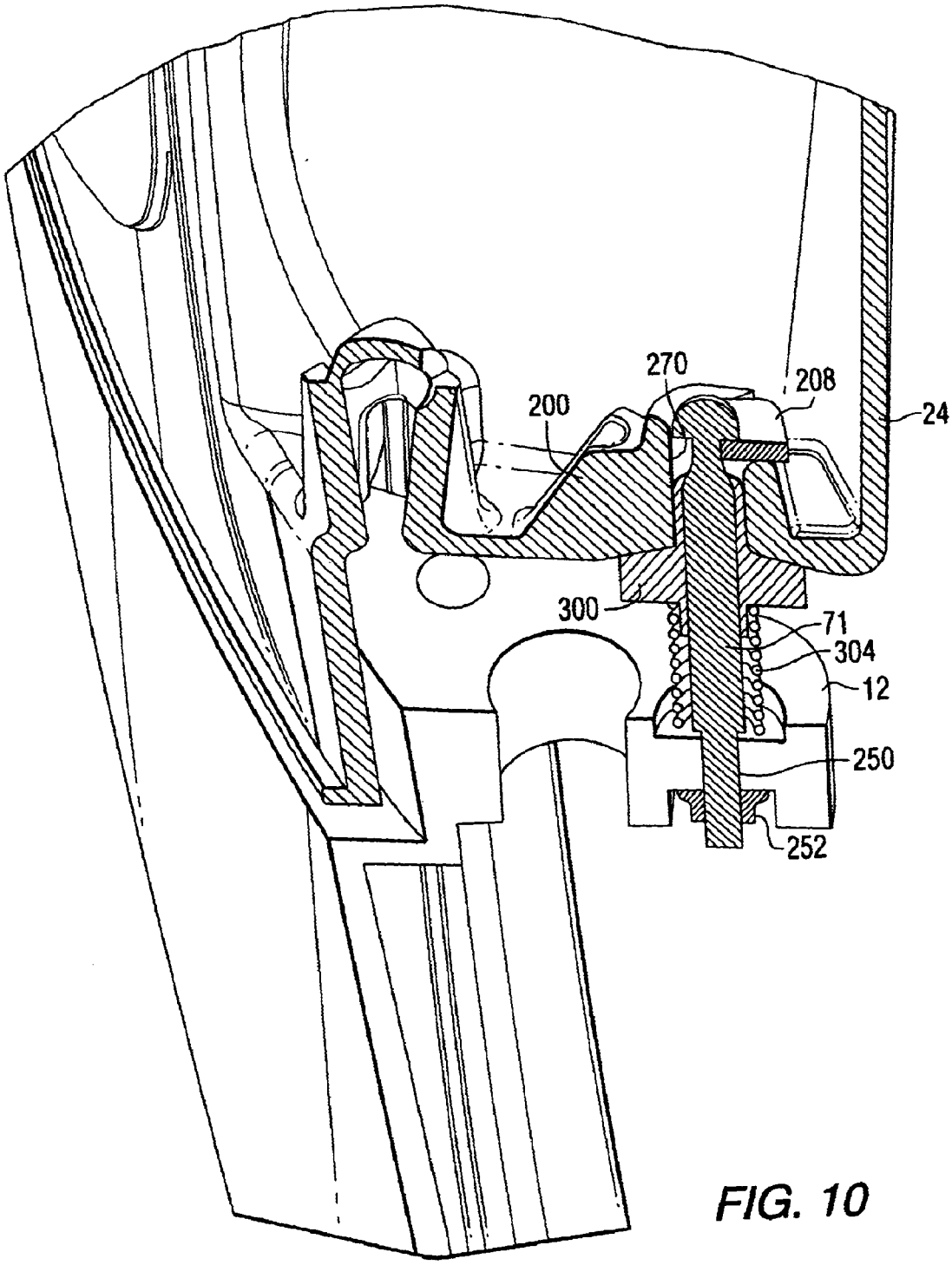
FIG. 10 is a sectioned isometric view of the components of the latch mechanism of the present invention.

FIG. 10 is a section view taken through the latch pin 71 and portions of the base portion 200. As shown in FIG. 10, a latch pin hole 250 is formed through the first cover member 12 and the latch pin 71 is disposed in the latch pin hole 250. The latch pin 71 is rigidly attached to the first cover member 12 by a threaded member 252 and a step formed within the latch pin 71, as illustrated in FIG. 10. The base portion 200 is a boss extending from a surface of the second cover member 24 and the pivot member, described above in conjunction with FIG. 9, extends through the pivot opening 204. The pivot member 202 is rotatable relative to the second cover member 24. With reference to FIG. 8, an insertion hole 270 is formed through the base portion 200 of the second cover member 24. The insertion hole 270 is shaped to receive the latch pin 71 and to allow the latch 208 to move into latching contact with the latch pin 71 when the first and second cover members, 12 and 24, are attached to each other.

Figure 11:
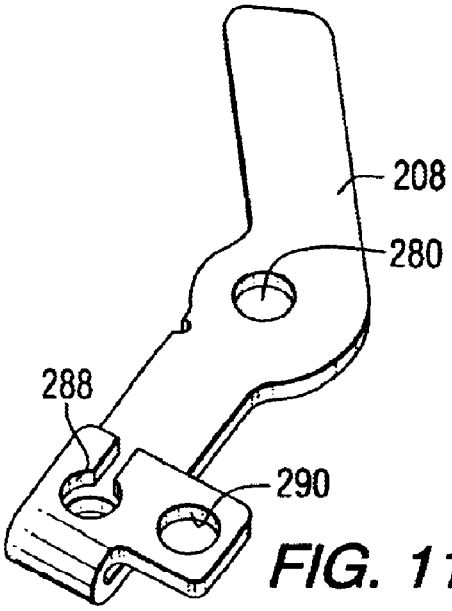
FIG. 11 shows the latch member of the present invention.
Figure 12:
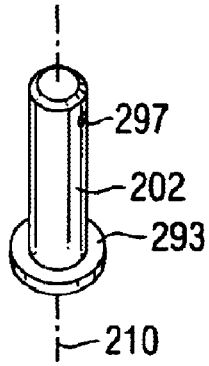
FIG. 12 shows the pivot member used to rotatably support the latch of the present invention.

FIGS. 11 and 12 illustrate the latch 208 and the pivot member 202. The latch 208 is provided with a hole 280 that is shaped to receive the pivot member 202 therethrough. That pivot member 202 is then held in position by the pin 230 described above in conjunction with FIG. 9. A portion of the latch 208 is shaped to receive the second end 132 of the push-pull cable assembly 82. That opening is identified by reference numeral 288 in FIG. 11. Another opening 290 in the latch 208 is shaped to receive the connector rod 97 that transfer force from the first latch structure 91 to the second latch structure 92, as described above in conjunction with FIGS. 6 and 9. The pivot member 202 is provided with a shoulder 293 that works in cooperative association with the pin 230 which is inserted into hole 297 which is formed through the pivot member 202.

In FIG. 10, the latch pin 71 is provided with a collar 300 that is disposed around the latch pin 71 and used to align the position of the latch pin with respect to the insertion hole 270. The spring 304 urges the collar 300 upwardly against the lower surface of the second cover member 24.

With reference to FIGS. 1–12, it can be seen that the present invention provides numerous advantages with respect to the cowl structure of an outboard motor 10. The first and second cowl members, 12 and 24, provide for easier removal and installation of the cowl structure, particularly when the internal combustion engine 34 is large and would normally require a large and heavy cowl structure to provide protection for the engine. The present invention makes it possible to use narrower cowl segments than would otherwise be possible with large four cycle engines. This is particularly important when the outboard motor is used in combination with other outboard motors in tandem applications where twenty-six inch mounting centers are highly desirable. The first cowl member 12 is extendible across a rear portion 16 of the outboard motor 10 and at least partially extendible along both the port and starboard sides of the outboard motor. The second cowl member 24 is attachable to the support structure 14 of the outboard motor 10 and to the first cowl member 12. The second cowl member is extendible across a front portion 22 of the outboard motor and at least partially extendible along the port and starboard sides of the outboard motor. In a preferred embodiment, the second cowl member 24 also extends across the top and rear portions of the outboard motor. A support structure 14, which resiliently supports the internal combustion engine 34, supports the cowl structure and provides a first latch mechanism for attaching the first cowl member 12 to the support structure 14 and a second latch mechanism for attaching the first cowl member 12 to the second cowl member 24. The first cowl member, or first cover member 24, comprises a groove which is shaped to receive a protruding edge 43 that is formed on the support structure 14.

A hinge, as shown in FIG. 4, is provided so that the second cowl member 24 is rotatable relative to the support structure 14 during attachment of the second cowl member 24. Both the first and second cowl members are supported by the support structure 14.

The second cover member 24 is attached to the first cover member 12 by a latching mechanism which comprises a base portion 200 of the latching device 91 which is formed as an integral part of the second cover member 24. A pivot member 202 extends through a hole 204 formed in the base portion 200. A latch 208 is attached for rotation about a central axis 210 of the pivot member 202 and the latch 208 is movable between a locking position (as shown in FIG. 9) and an unlocking position. A latch pin 71 is attached to the first cover member 12 and shaped to be retained by the latch 208 when the first and second cover members, 12 and 24, are in contact with each other and the latch is in the locking position. A spring 85, along with the torsional spring described above, are provided for urging the latch 208 toward its locking position. The spring causes the internal cable of the push-pull cable assembly 82 to rotate the latch 208 in a counterclockwise direction about axis 210. A pivot hole 204 is formed through the base portion 200 and the pivot member 202 extends through the pivot hole. A pin 230 is attached to the pivot member 202 to prevent the pivot member from being removed from the pivot hole 204. The push-pull cable 82 has a first end 131 and a second end 132, with the second end 132 being attached to the latch 208 and the first end 131 being attached to the handle 80. The handle 80 is manually movable relative to the second cover member 24 to cause the latch 208 to rotate in a clockwise direction about the central axis 210 of the pivot member 202. This allows the latching mechanism to be placed in the unlatching position. A sheath of the push-pull cable is attached to the second cover member 24 at several locations between the handle 80 and the latch 208. A latch pin hole 250 is formed in the first cover portion 12 and the latch pin 71 is inserted into the latch pin hole 250 for rigid attachment to the first cover member 12. The base portion 200, in a preferred embodiment is a boss that extends from a surface of the second cover member 24. The pivot member 202 extends through the base portion 200 and, in certain embodiments, is rotatable relative to the second cover member 24. In alternative embodiments, the pivot member 202 is fixed with respect to the boss portion 200 and the latch 208 is rotatable relative to the pivot member 202. An insertion hole 270 is formed through the second cover member 24 and is shaped to receive the latch pin 71 and to allow the latch 208 to move into contact with the latch pin 71 when the first and second cover members, 12 and 24, are attached to each other.

The latching mechanism described above provides significant benefits over those known in the prior art. Latch structures are typically provided as independent metal components that are attached to the cowl structure by screws or bolts. These individual latch mechanism require additional assembly time to connect them to their associated latch members. In addition, the metallic components add weight to the cowl structure. By providing a base portion 200 that is an integral part of the cowl, those additional parts are not required. In a preferred embodiment of the present invention, the latch mechanism only requires the additional components identified above as the latch 208, the pivot member 202, and the pin 230. The push-pull cable 82 and the connector bar 97 would typically be required in previously known latching mechanisms.

Although the present invention has been described with considerable detail and illustrated to show several embodiments, it should be understood that alternative embodiments are also within its scope.

We claim:

1. An outboard motor, comprising:

a support structure;

a first cowl member which is attachable to a support structure of said outboard motor, said first cowl member being extendable across a rear portion of said outboard motor and at least partially extendable along both port and starboard sides of said outboard motor;

a second cowl member which is attachable to said support structure and to said frist cowl member, said second cowl member being extendable across a front portion of said outboard motor and at least partially extendable along said port and starboard sides of said outboard motor; and a first latch mechanism for attaching said first cowl member to said support structure.

2. The outboard motor of claim 1, further comprising:

a second latch mechanism for attaching said first cowl member to said second cowl member.

3. The outboard motor of claim 1, wherein:

said first cowl member comprises a groove which is shaped to receive a protruding edge formed on said support structure.

4. The outboard motor of claim 1, wherein:

said first and second cowl members are supported by said support structure.

5. The outboard motor of claim 1, further comprising:

an internal combustion engine disposed under said first and second cowl members and supported by said support structure through isolating resilient mounts.

6. The outboard motor of claim 1, wherein:

said second cowl extends at least partially over a top portion of said outboard motor.

7. The outboard motor of claim 1, wherein:

said second cowl extends at least partially over a rear portion of said outboard motor.

8. An outboard motor comprising:

a first cowl member which is attachable to a support structure of said outboard motor, said first cowl member being extendable across a rear portion of said outboard motor and at least partially extendable along both port and starboard sides of said outboard motor;

a second cowl member which is attachable to said support structure and to said first cowl member, said second cowl member being extendable across a front portion of said outboard motor and at least partially extendable along said port and starboard sides of said outboard motor; and a hinge about which said second cowl member is rotatable relative to said support structure.

9. An outboard motor, comprising:

a support structure;

an internal combustion engine supported by said support structure;

a first cowl member which is attachable to said support structure, said first cowl member extending across a rear portion of said outboard motor and at least partially on both port and starboard sides of said outboard motor;

a second cowl member which is attachable to said support structure and to an upper segment of said first cowl member, said second cowl member extending across a front portion of said outboard motor and at least partially on said port and starboard sides of said outboard motor;

a first latch mechanism for attaching said first cowl member to said support structure; and a second latch mechanism for attaching said first cowl member to said second cowl member.

10. The outboard motor of claim 9, further comprising:

a drive shaft housing attached to said support structure; and a drive shaft connected in torque transmitting association with said internal combustion engine and disposed within said drive shaft housing.

11. The outboard motor of claim 10, further comprising:

a hinge about which said second cowl member is rotatable relative to said support structure, said first cowl member comprising a groove which is shaped to receive a protruding edge formed on said support structure, said first and second cowl members being supported by said support structure.

12. The outboard motor of claim 11, further comprising:

an internal combustion engine disposed under said first and second cowl members and supported by said support structure through isolating resilient mounts, said second cowl extending at least partially over a top portion of said outboard motor and said second cowl extending at least partially over a rear portion of said outboard motor.

* * * * *